United States Patent [19]

Mogensen et al.

[11] 4,267,878

[45] May 19, 1981

[54] APPARATUS FOR PRODUCING CASTING MOULD PARTS BY COMPRESSING SAND OR A SIMILAR MATERIAL BETWEEN A PRESSURE PLATE AND A COUNTER-PRESSURE PLATE

[75] Inventors: Vagn Mogensen, Gentofte; Villy E. Jørgensen, Ølstykke; Peter Krebs, Herlev, all of Denmark

[73] Assignee: Dansk Industri Syndikat A/S, Herlev, Denmark

[21] Appl. No.: 151,607

[22] Filed: May 20, 1980

[30] Foreign Application Priority Data

Jun. 1, 1979 [DK] Denmark ..... 2304/79

[51] Int. Cl.[3] ..... B22C 15/08

[52] U.S. Cl. ..... 164/187; 92/66; 164/213

[58] Field of Search ..... 164/40, 187, 212, 213; 92/66, 117 R

[56] References Cited

U.S. PATENT DOCUMENTS

| | | | |
|---|---|---|---|
| 2,851,999 | 9/1958 | Kratz | 92/66 X |
| 3,749,151 | 7/1973 | George et al. | 164/187 X |
| 3,999,594 | 12/1976 | Gunnergaard | 164/187 |

FOREIGN PATENT DOCUMENTS

| | | | |
|---|---|---|---|
| 508328 | 6/1976 | U.S.S.R. | 164/187 |

*Primary Examiner*—Robert D. Baldwin
*Attorney, Agent, or Firm*—Imirie & Smiley

[57] ABSTRACT

In an apparatus for producing casting mould parts and comprising a pressure or squeeze chamber with movable end walls formed by a pressure plate and a counter-pressure plate, the hydraulic drive units for the said plates are constituted by piston/cylinder devices, in which the piston members are stationary, while the cylinder members are connected with the plates and dimensioned so as to stand up to any bending stresses exerted by said plates.

2 Claims, 2 Drawing Figures

APPARATUS FOR PRODUCING CASTING MOULD PARTS BY COMPRESSING SAND OR A SIMILAR MATERIAL BETWEEN A PRESSURE PLATE AND A COUNTER-PRESSURE PLATE

FIELD OF THE INVENTION

The invention relates to an apparatus for producing casting mould parts by compressing sand or the like between a pressure plate and a counter -pressure plate forming movable end walls of a pressure chamber which subsequent to the production of a mould part can be opened by displacing away the counter-pressure plate, whereafter the mould part can be pushed out from the pressure or squeeze chamber by a further movement of the pressure plate in its squeezing direction, both plates being movable by means of a respective one of two aligned hydraulic drive units each comprising a piston and a cylinder, and the counter-pressure plate being connected to the associated drive unit by means of pull and push rods arranged in parallel with the squeezing direction and an interconnecting cross member, whereas the pressure plate is directly connected to the other drive unit.

BACKGROUND OF THE INVENTION

Each of the hydraulic drive units in foundry devices of this type usually comprises a stationary cylinder and a piston operating therein, one of the piston rods being firmly connected directly with the pressure plate while the other one is indirectly connected with the counter-pressure plate, viz. through the cross member and the pull and push rods. The two cylinders may be built together so as to constitute a stationary unit and are axially in alignment with each other and with the pressure or squeeze chamber, so that the power transmission to the pressure and counter-pressure plates can take place as simply as possible.

It is moreover known, for instance from German Offenlegungsschrift DE-OS No. 25 28 648 (Henry Wallwork & Company Ltd.) to make use of a drive unit comprising an axially movable cylinder which through pull and push rods is firmly connected to one of the plates, and a piston operating in said cylinder, the piston rod of which supports the second plate. Thus, this provides for saving a cylinder and an associated piston, but on the other hand particular measures are required for the control of the cylinder movement, and it is likewise necessary to make use of movable conduits or hoses for the hydraulic pressure medium.

SUMMARY OF THE INVENTION

The apparatus according to the invention differs from the above prior art in that the drive units comprise movable cylinder members connected to the cross member and to the pressure plate, resp., and associated stationary piston members each having a piston rod extending tightly through an inner end wall of the associated cylinder member, and a piston head dividing the chamber of said cylinder member into an outer end compartment and an inner annular compartment surrounding the piston rod, both compartments being provided with inlet and outlet connections for a pressure fluid.

A particular advantage of this design is that it is possible to relieve the piston rods of bending forces, because these forces are mainly carried by the cylinder members that are firmly connected with the pressure plate and the cross member, resp., and which without difficulty can be made sufficiently rigid to stand up to the bending stresses. In this respect it is pointed out that the reactive forces from the sand while its being compressed between the two plates may vary considerably across their front surfaces with the associated half-patterns so that the resultant of these reactive forces cannot be expected to be parallel to the axis of the pressure or squeeze chamber and, consequently, to the axis of the drive units, nor can the resultant be expected to be directed towards the point in which this axis intersects the front surfaces of the plates so that the bending stresses may become rather considerable.

It further applies to the design according to the invention that movable conduit or hose connections can be avoided because the necessary inlet and outlet channels for the pressure fluid can be provided in a block formed by the stationary piston members. Moreover, the cross member associated with the counter-pressure plate may be secured to the associated cylinder member at the inner end thereof, whereby the length of the pull and push rods between the counter-pressure plate and the cross member may be reduced and larger space may be left for the operating staff at the cylinder member concerned.

DETAILED DESCRIPTION OF THE PREFERRED EMBODIMENT

Figure 1:
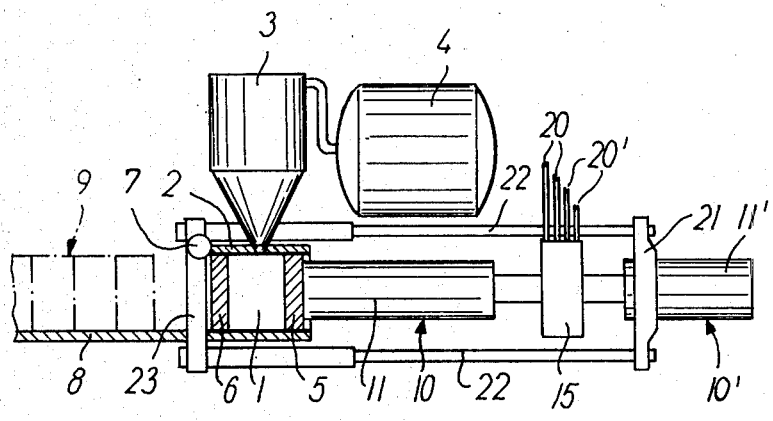
FIG. 1 is a somewhat diagrammatical side view, partially in section, of a preferred embodiment of the entire apparatus, and FIG. 2 a sectional view to a larger scale of the hydraulic drive unit of the apparatus.

The apparatus comprises in an ordinary way a pressure or squeeze chamber 1 with a top plate 2 having an aperture through which sand or another mould material can be injected from a hopper 3 which through a conduit with a valve (not shown) is connected to a compressed-air vessel 4. The chamber 1 is closed at its ends by a pressure plate 5 and a counter-pressure plate 6 supposed to support half-patterns (not shown) on their inner or front surfaces to shape corresponding casting cavities in the end surfaces of the mould part formed by the compression of the sand. Subsequent to the final compression of said mould part the counter-pressure plate 6 may be moved out of the chamber 1 and be swung upwardly in a hinge 7, whereafter a further displacement in the direction to the left may be applied to the pressure plate 5 for conveying the produced casting mould to a guide path 8 on which it is added to a mould 9 made up by quite corresponding mould parts. When the parts have been brought back to the position shown in FIG. 1, the procedure can be repeated so as to produce and close up the next mould part.

Figure 2:
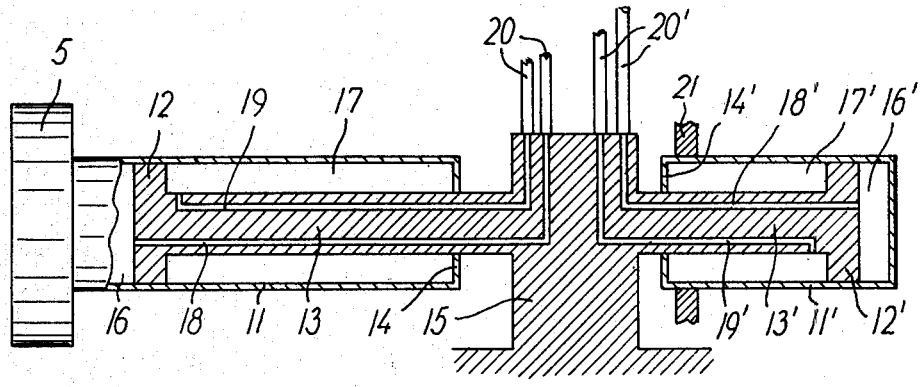

The movement of displacement of the pressure plate 5 is derived from a hydraulic drive unit 10 comprising a cylinder member 11, see also FIG. 2, to which the pressure plate 5 is firmly secured, and a piston member comprising a head 12 and a piston rod 13 that passes tightly through an inner end wall 14 of the cylinder 11 and is supported by a stationary block 15. The piston member divides the cylinder chamber into an outer end compartment 16 and an inner annular compartment 17 which through channels 18 and 19 in the piston member 12,13 and the block 15 are connected to exterior conduits 20 for supply and discharged of pressure fluid. A maximum pressure on the pressure plate 5, for the compression of the sand in the chamber 1 and for the conveyance of the casting mould 9 subsequent to the addition of a newly produced mould part, is obtained by supplying pressure liquid to the end compartment 16 and by free discharge from the annular compartment 17. If desired, the liquid displaced from the annular compartment may be fed to the end compartment to achieve an accelerated movement of the pressure plate 5. If the cross-sectional area of the annular compartment is half the size of the cross-sectional area of the end compartment, then the pressure plate may in this situation, and as far as a given pump capacity is concerned, have the same speed as that obtained by a movement in the opposite direction and effected by supplying pressure fluid to the annular compartment 17 and free discharge from the end compartment 16.

The counter-pressure plate 6 comprises an analogous drive unit 10' with a cylinder member 11', a piston head 12', a piston rod 13' also supported by the block 15, an inner cylinder wall 14', an outer end compartment 16', an inner annular compartment 17' and channels 18' and 19' in connection with external conduits 20'. In this case too it is actually the cylinder member 11' that constitutes the movable element, and said member 11' is connected to the counter-pressure plate 6 through a cross member 21 secured to the cylinder 11' at the inner end thereof, said cross member 21 being connected through parallel pull and push rods 22 with a frame 23 supporting the plate 6 in the hinge 7.

What is claimed is:

1. An apparatus for producing casting mould parts by compressing sand or the like between a pressure plate and a counter-pressure plate forming movable end walls of a pressure chamber which subsequent to the production of a mould part can be opened by displacing away the counter-pressure plate, whereafter the mould part can be pushed out from the pressure or squeeze chamber by a further movement of the pressure plate in its squeezing direction, both plates being movable by means of a respective one of two aligned hydraulic drive units each comprising a piston and a cylinder, and the counter-pressure plate being connected to the associated drive unit by means of pull and push rods arranged in parallel with the squeezing direction and an interconnecting cross member, whereas the pressure plate is directly connected to the other drive unit, said drive units comprising movable cylinder members connected to the cross member and to the pressure plate, respectively, and associated stationary piston members each having a piston rod extending tightly through an inner end wall of the associated cylinder member, and a piston head dividing the chamber of said cylinder member into an outer end compartment and an inner, annular compartment surrounding the piston rod, both compartments being provided with inlet and outlet connections for a pressure fluid.

2. An apparatus according to claim 1, wherein the inlet and outlet connections for the pressure fluid to the two compartments are constituted by channels extending through the associated stationary piston.

* * * * *